US005181629A

United States Patent [19]

Camm et al.

[11] Patent Number: 5,181,629

[45] Date of Patent: * Jan. 26, 1993

[54] COMBINATION MIXER DISPENSER

[76] Inventors: James O. Camm, 51 Millewa Ave., Chadstone Victoria; Stephen J. Camm, 11 Kaisman Sq., Wantirna Victoria, both of Australia

[ * ] Notice: The portion of the term of this patent subsequent to Sep. 24, 2008 has been disclaimed.

[21] Appl. No.: 718,994

[22] Filed: Jun. 21, 1991

Related U.S. Application Data

[63] Continuation of Ser. No. 534,468, Jun. 7, 1990, Pat. No. 5,050,774.

[30] Foreign Application Priority Data

Jun. 13, 1989 [AU] Australia ..... PJ4700

[51] Int. Cl.[5] ..... B67D 5/00

[52] U.S. Cl. ..... 222/80; 222/137; 222/389

[58] Field of Search ..... 222/386, 387, 388, 389, 222/390, 391, 392, 80, 135, 136, 137, 386.5, 406, 482, 485; 83/639.1, 946

[56] References Cited

U.S. PATENT DOCUMENTS

| | | | |
|---|---|---|---|
| 213,978 | 4/1879 | Dibble | 222/386 X |
| 591,352 | 10/1897 | Hunter | 222/390 X |
| 674,126 | 5/1901 | Simms | 222/390 X |
| 1,653,594 | 12/1927 | Thomas | 222/390 X |
| 1,716,485 | 6/1929 | Davis | 222/386 X |
| 2,001,819 | 5/1935 | Elle et al. | 222/386 X |
| 2,656,953 | 10/1953 | Rich | 222/386 X |
| 2,751,126 | 6/1956 | Chandler | 222/386 |
| 3,007,611 | 11/1961 | Coolidge | 222/137 |
| 3,266,671 | 8/1966 | Gelpey | 222/137 X |
| 3,489,147 | 1/1970 | Shaw | 222/137 X |
| 3,620,417 | 11/1971 | Simms | 222/136 |
| 3,675,821 | 7/1972 | Morane et al. | 222/80 |
| 4,029,236 | 6/1977 | Carson, Jr. et al. | 222/135 |
| 4,386,717 | 6/1983 | Koob | 222/136 X |
| 4,493,436 | 1/1985 | Brokaw | 222/137 X |
| 4,690,306 | 9/1987 | Stäheli | 222/162 X |

FOREIGN PATENT DOCUMENTS

| | | | |
|---|---|---|---|
| 0093185 | 11/1983 | European Pat. Off. . | |
| 0336916 | 10/1989 | European Pat. Off. | 222/135 |
| 2521392 | 11/1976 | Fed. Rep. of Germany | 222/137 |
| 2082686 | 3/1982 | United Kingdom | 222/137 |

*Primary Examiner*—Andres Kashnikow
*Assistant Examiner*—Anthoula Pomrening
*Attorney, Agent, or Firm*—Larson and Taylor

[57] ABSTRACT

A dispenser for dispensing two components is disclosed which comprises a drum 10 in which a tube 20 is supported. A first piston 12 is arranged within the drum 10 and has an opening 22 through which the tube 20 extends. The opening is provided with a plug 80 which has an aperture also through which the tube 20 extends. The plug supports a blade 32 which bears on a second piston 40 arranged within the tube 22. The plug 80 is fixed relative to the piston 12 so that it and the blade 32 move with the piston 12. During movement of the piston 12 the blade 32 slices the tube 20 and bears against the second piston 40 so that the first piston 12 and the second piston 40 move in a fixed manner as a single unit. During movement of the pistons 12 and 40 the two components are dispensed from the drum 10 and the tube 22 in a particular ratio depended upon the volume displaced by movement of the pistons 12 and 40. The dispensed components can therefore be mixed together in the predetermined ratios.

5 Claims, 3 Drawing Sheets

COMBINATION MIXER DISPENSER

This is a continuation of Ser. No. 07/534,468, filed Jun. 7, 1990 and now U.S. Pat. No. 5,050,774.

This invention relates to a dispenser for dispensing and enabling mixture of two components and has particular application to dispensing and mixing two-part polymers which remain inert before mixing, but react to form a solid upon mixing. One specific example of the invention relates to the mixing of a putty and hardener for use in car body work wherein the putty and hardener are generally mixed in a ratio of 50:1.

Initial methods of mixing the putty and hardener comprise dispensing the putty from a 20 kilogram drum and manually adding a certain amount of hardener to the putty in order to form the solid material. When mixing putty with hardener for use in body work it is important that the ratio of 50:1 be strictly adhered to and therefore this method involves considerable manual activity to ensure that the correct amount of each component is obtained and mixed. In view of this an automatic method of mixing the two components was developed in which the putty was dispensed from the drum and the hardener was dispensed from a container by the use of movable pistons in the drum and container. The container was generally arranged outside of the drum and the two pistons were interlinked by a linkage so that upon movement of one piston the other piston was caused to move so that material was dispensed from both the drum and the container. By suitably sizing the pistons and drum and container the desired amount of each material was obtained for mixing. However, it has been found that in order to enable movement of the pistons the linkage must be relatively long and this results in some relative movement between the pistons rather than precise movement of the pistons relative to one another. Thus, with the linkage system it is possible that an incorrect amount of hardener will be dispensed compared to the amount of putty and therefore the two substances will not be mixed in the correct ratio. Furthermore, the linkage system is generally awkward and requires considerable time and effort to initially set up.

U.S. Pat. No. 3,007,611 dated 7th Nov. 1961 discloses a dispenser which includes a single movable piston and two compartments which are at least partly divided by metal foil. The two compartments include two different components and they are dispensed by movement of the single piston. Movement of the single piston is at least partially accommodated by the single piston tearing or folding down the metal foil. One problem with this arrangement is that a good seal is not provided between the torn metal foil and the piston and therefore the two components can mix in the dispenser thereby causing the formation of a solid if the two components are of a nature which are to be mixed to form a solid.

The object of the present invention is to provide a dispenser which overcomes these problems.

The invention may be said to reside in a dispenser for dispensing two components, said dispenser comprising a first container for containing one of the components and a second container for containing a second of the components, said first container having a first piston for movement in the first container for forcing the first component out of the first container, said second container having a second piston for forcing the second component out of the second container, a second piston moving means including a cutting means fixed relative to the first piston for cutting said second container as the first piston is moved, said second piston moving means being for moving said second piston relative to said second container when said first piston is moved to thereby cause movement of the first piston and the second piston in a fixed manner relative to one another to dispense a predetermined amount of the first component and second component from the first and second containers respectively, and wherein cutting of the second container by the cutting means enables movement of the first piston, the second piston moving means and the second piston relative to the first container and the second container.

Since the device includes cutting means the first piston can effectively be coupled to the second piston and movement can take place by virtue of the cutting means cutting the second cylinder to enable fixed movement of the two pistons relative to one another so that an exact amount of the first and second components is dispensed from the first and second containers to ensure a correct ratio of the first and second components for mixing. Furthermore, since the present invention utilizes first and second pistons a good seal is still maintained within the two containers notwithstanding the cutting of the second container and therefore mixing of the two components within the dispenser is not possible.

Preferably the second container is arranged within the first container and the first piston has an opening through which the second container extends, said second piston moving means comprising a blade extending across said opening and being mounted above said second piston such that upon movement of the first piston the end portions of the blade slice the second container and an intermediate portion of the blade abuts the second piston and pushes the second piston to cause the second piston to move with the first piston relative to the second container.

Preferably the blade is held in a plug which is fitted into said opening in said first piston, said plug having an aperture through which the second container projects during movement of the first and second pistons.

In the preferred embodiment of the invention the first piston and therefore the second piston is moved by virtue of air pressure applied above the first piston. In the past, the single container for dispensing putty was in the form of a 20 liter drum which occasionally included inner projections and irregularities which may create an air gap between the piston and drum thereby enabling air to flow beneath the piston which, in turn, can add to the error in the ratio of components dispensed. In order to overcome, or at least reduce the likelihood of this occurring, the preferred embodiment of the invention utilizes a bladder which is arranged above the first piston into which pressurized air is introduced to thereby expand the bladder and force the first piston to move relative to the first container.

A preferred embodiment of the invention will be described, by way of example, with reference to the accompanying drawings in which.

Figure 1:
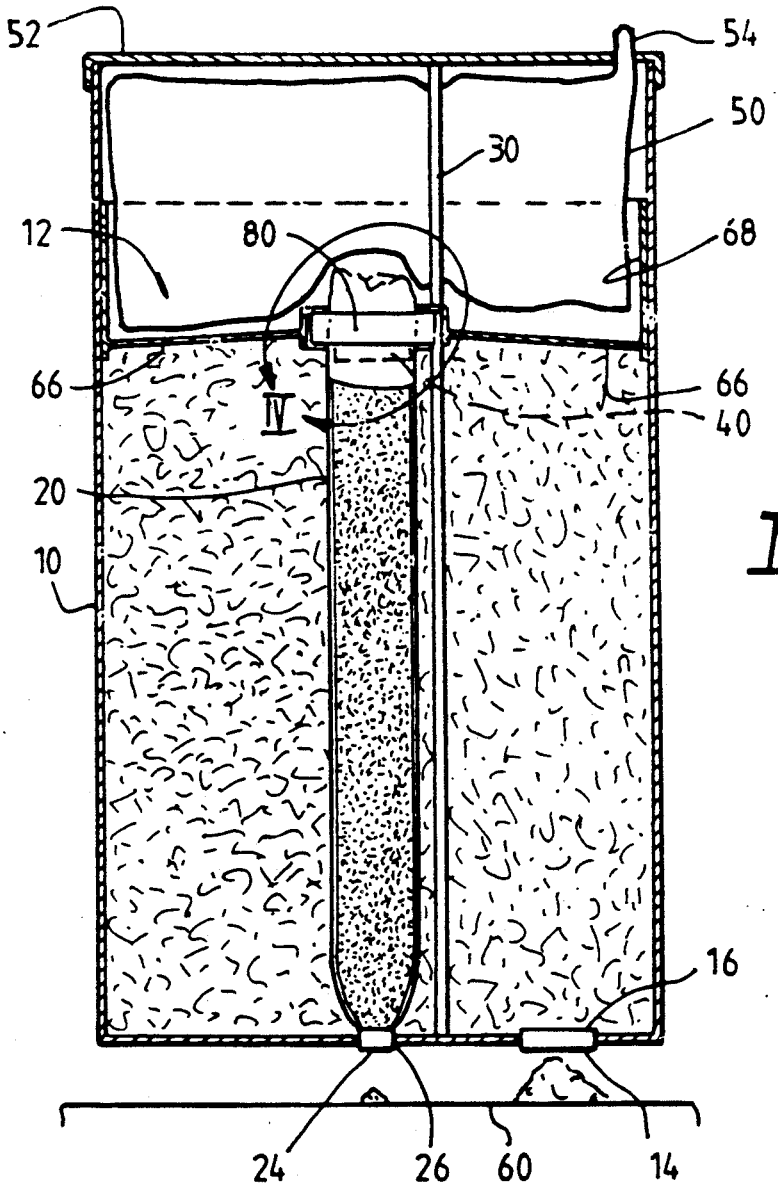
FIG. 1 is a cross-sectional view of a dispenser embodying the invention.

With reference to the drawings, FIG. 1 shows a dispenser embodying the invention which comprises an outer drum 10 in which is located a first piston 12 which has a diameter which closely matches the inner diameter of the drum 10 (i.e. to prevent creepage of the material in the drum past the piston 12). Contained within the drum 10 and below the piston 12 is a first component such as a putty for use in body work for automobiles. The drum 10 has a first opening 14 which is provided with a valve 16 through which the putty can be dispensed. An inner tube 20 is arranged within the drum 10 and extends through an opening 22 in the piston 12. The tube 20 is provided with a second component such as hardener for mixing with the putty to form a solid. The tube 20 directly communicates with a second opening 24 in the drum 10 which may be provided with a valve 26 through which the hardener is dispensed.

A plug 80 is arranged within the opening 22 in the first piston 12 and supports a cutting blade 32 which is held generally vertical by the plug 80. The cutting blade 32 is of such a length to extend diametrically across the tube 20. However, in other embodiments the blade 32 could be offset relative to the diameter of the tube 20 and effectively be smaller than the diameter of the tube 20 but sufficiently large to cut through space apart wall portions of the tube.

A second piston 40 is arranged beneath the blade 32 and is dimensioned to fit within the tube 20.

A bladder 50 is arranged within the space between the piston 12 and a removable top 52 of the drum 10. The bladder 50 is for communication with a source of pressurized air via a hose 54 or the like.

The assembly is initially installed with the piston 40 arranged in the top of the tube 20 and with the blade 32 resting on the top ends of the wall of the tube 20 or initially cutting into the tube 20 until the blade abuts the piston 40. In order to dispense material from the tube 20 and the drum 10 pressurized air is forced into the bladder 50 to thereby expand the bladder 50 which in turn pushes the first piston 12 downwardly. Since the blade 32 is connected to the plug 80 which is retained within the opening 22 in the first piston 12, the blade 32 is forced downwardly with the first piston 12.

Movement of the blade 32 causes the end portions of the blade 32 to cut into the tube 20 to thereby vertically slice the tube 20 so that the middle or intermediate portion of the blade engages the second piston 40 and pushes the second piston 40 downwardly in a fixed manner and without any relative movement between the first piston 12 and the second piston 40.

Since contact of the blade 32 on the piston 40 pushes the piston 40 downwardly and the blade 32 is fixed relative to the piston 12, movement of the piston 40 is thereby effectively fixed relative to the piston 12 so that the piston 12 and piston 40 move in a fixed manner relative to one another. The amount of components dispensed is determined by the volume displaced by the movement of the pistons 12 and 40 and therefore a predetermined amount of material from the tube 20 and the drum 10 is dispensed through the valves 16 and 26 as the pistons 12 and 40 move down in the fixed manner. Thus, predetermined proportions of the two components are dispensed onto a tray or plate 60 for mixing together. The second piston 40 also seals the tube 20 and prevents the component in the tube 20 from mixing with the component in the drum 10 when the tube 20 is sliced by the blade 32.

Figure 2:
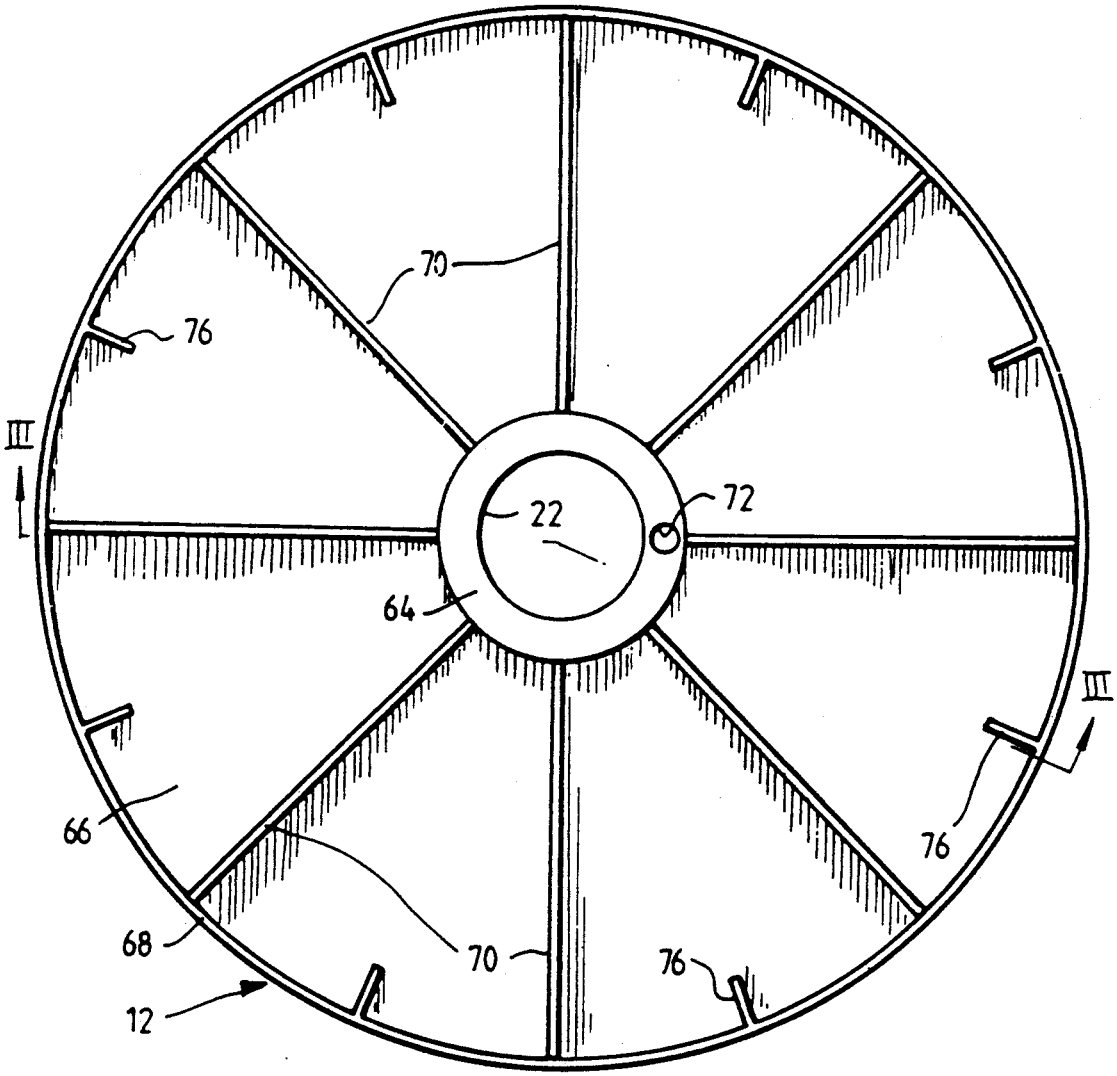
FIG. 2 is a detailed plan view of a piston used in the embodiment of FIG. 1.
Figure 3:
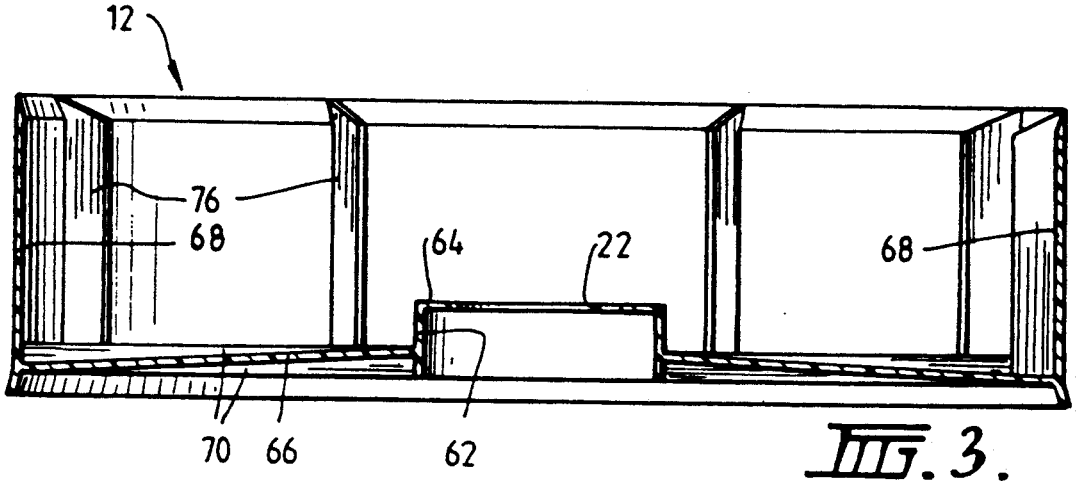
FIG. 3 is a cross-sectional view along the line III—III of FIG. 2.

As best shown in FIGS. 2 and 3, the aperture 22 is generally defined by a short sleeve section 62 which is provided with an annular flange 64. The surface 66 of the piston 12 which contacts the material in the drum 10 is inclined as best seen in FIG. 3. The surface 66 joins a vertical wall 68 and is provided with a number of radially extending ribs 70 which are best seen in FIG. 2. The surface 66 is inclined since it has been found that this is the natural position the surface tends to take up as the piston 12 is forced downwardly into the drum against the pressure of the putty in the drum. The ribs 70 are preferably horizontal and, as best seen in FIG. 3, have a portion which extends below the surface 66. The vertical wall 68 is provided with ribs 76 which are spaced about the circumference of the wall 68.

Figure 4:
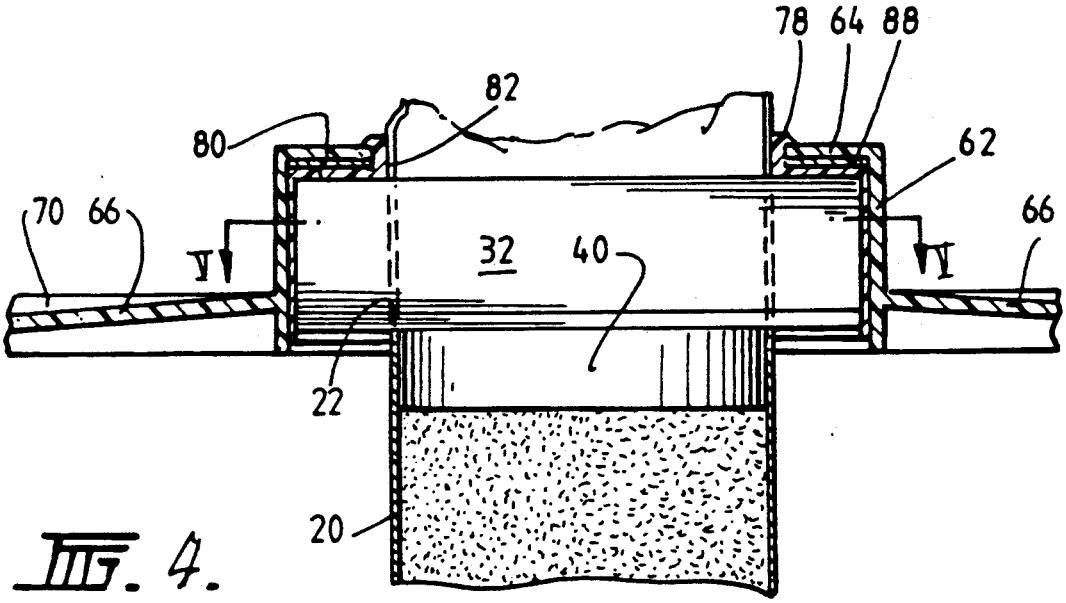
FIG. 4 is a detailed view of the circle part marked IV of FIG. 1.
Figure 5:
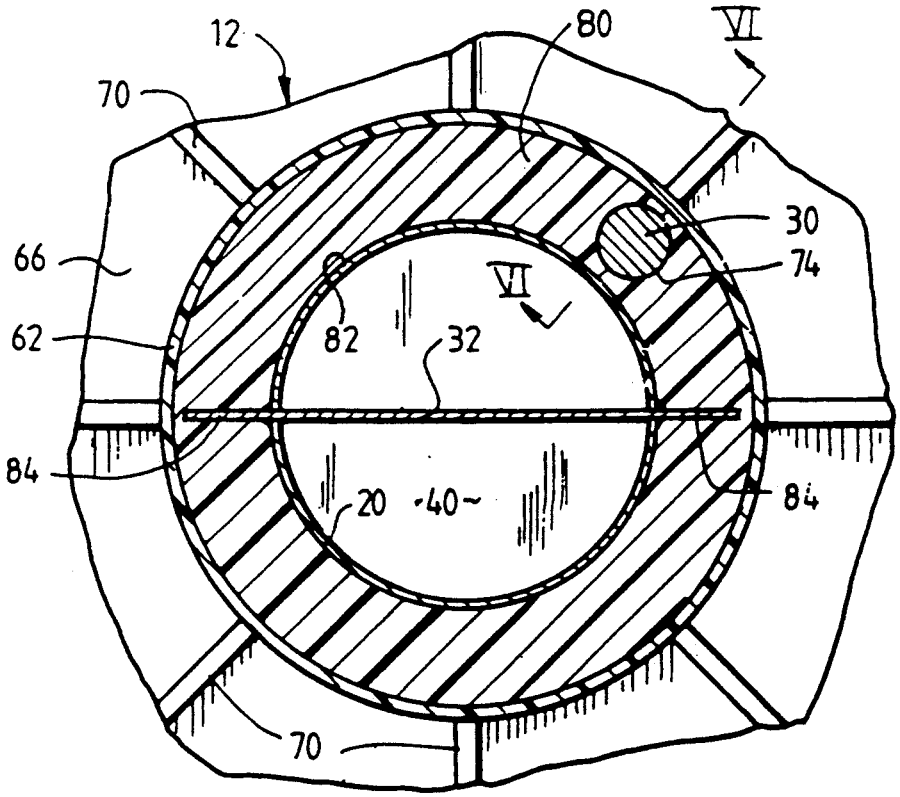
FIG. 5 is a view along the line V—V of FIG. 4.

As is best seen in FIGS. 4 and 5, the opening 22 of the piston is provided with an annular plug 80 which is provided with a central aperture 82. The plug 80, as best seen in FIG. 5, is provided with diametric slits 84 which receive the blade 32 and hold the blade vertically across the aperture 22.

Figure 6:
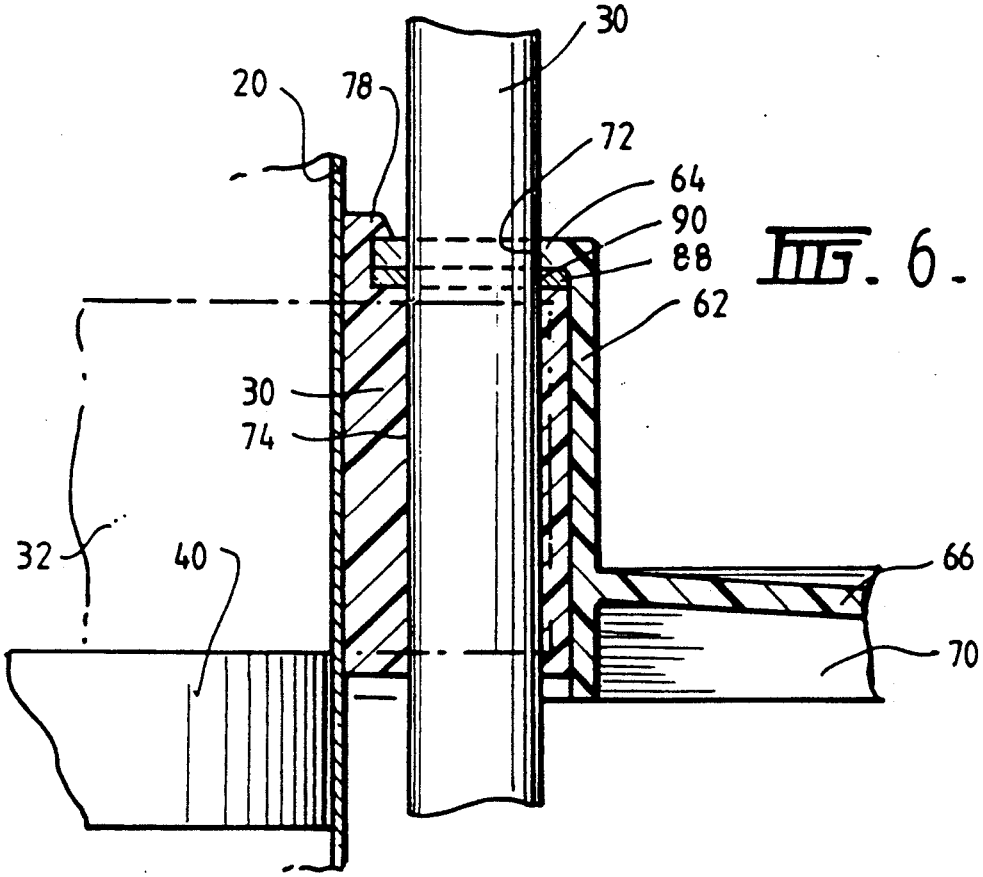
FIG. 6 is a detailed view of part of FIG. 4.

The plug 80 is a snap fit onto the flange 64 as seen in FIG. 6 and is therefore held fixed relative to the piston 12. The plug 80 includes an annular leg 78 (FIG. 6) which clips over the flange 64 to securely hold the plug in opening 22. An annular shim 88 is arranged between the flange 64 and the blade 32 to prevent the upper surface of the blade 32 from cutting into the flange 64. The shim 88 is preferably made of metal or other hard material which is not prone to cutting by the blade 32.

The piston 40 is separate from the blade 32 and is arranged beneath the blade 32 and is dimensioned to fit within the tube 20. When the piston 12 is moved downwardly the plug 80 and therefore the blade 32 will also move downwardly forcing the piston 40 downwardly into the tube 20 so that the putty within the drum 10 and the hardener within the tube 20 is forced out of the valves 16 and 26 respectively. Since the blade 32 is effectively coupled to the piston 12 and pushes the piston downwardly, the piston 40 and piston 12 move in a fixed manner downwardly as the bladder is inflated. That is, there is no relative movement of the piston 12 relative to the piston 40 and both the piston 12 and piston 40 move as one in a fixed manner relative to one another. Thus, the valve 26 and the valve 16 can ensure that a precise amount of the putty and hardener is dispensed from the drum 10 and the tube 20 in precisely the correct ratio for proper mixing and formation of the required solid.

In the preferred embodiment of the invention a rod 30 is provided which extends from the base of the drum 10 to the lid of the drum 10 to hold the base of the drum and lid of the drum fixed relative to one another. The rod 30 tends to prevent bowing or movement of the base and lid when the pistons 12 and 40 are moved. Apart from preventing movement of the base lid of the drum 10, the use of the rod 30 also enables a lighter gauge metal to be used in manufacture of the base and lid. As is best shown in FIGS. 2, 5 and 6, the flange 64 is provided with a through hole 72 for receiving the rod 30. The plug 80 is also provided with a through hole 74 for accommodating the rod 30 and enabling the piston 12 and the plug 80 to move downwardly relative to the rod 30. The rod 30 is a tight fit in the holes 74 and 72 to prevent seepage of material from beneath the piston 12 through the holes into the space above the piston 12. The bladder 50 is, of course, wrapped around the rod 30 so that the rod 30 does not interfere with inflation of the bladder 50. The shim 88 is also provided with an opening 90 through which the rod 30 extends to accommodate movement of the shim 88 with the plug 80 and piston 12 relative to the rod 30.

Preferably the rod 30 is held at its ends in washers or other suitable sleeves or bosses which are fixed to the base and lid of the drum 10 which can securely engage the rod 30 to prevent flexing of the base and lid of the drum 10.

It is preferred that the tube 20 is made from a plastics material or thin aluminium etc. so that it can easily be sliced or cut by the blade 32 to accommodate movement of the piston 40 and blade 32 downwardly relative to the tube 20. However, depending on the material which is contained within the drum 10 and the tube 20 it may be desired to form the tube 20 from metal. In such embodiments it may be preferred to initially split the tube 20 into two halves and then join the two halves together by lead or solder or any other suitable soft sealing material. The blade 32 would then be arranged above the lead to soldered joints between the two halves so that the lead or soldered joint can be easily cut by the blade 32 as the piston 12 moves downwardly relative to the tube 20.

In the preferred embodiment of the invention the piston 40 is separate from the blade 32 and is merely pushed below the blade 32 as the first piston 12 is moved. However, in other embodiments (not shown) it would be possible to fix the second piston 40 onto the blade 32 so that the intermediate portion of the blade 32 merely comprises a fixing beam or bar onto which the second piston 40 is connected with the end portions of the blade 32 comprising the cutting elements which slice the tube 20.

Depending on the material from which the second piston 40 is made it may also be desirable to include a shim 88 (not shown) on the top surface of the piston 40 to prevent the shim 40 from being cut by the blade 32 when the blade 32 pushes against the shim 40.

In the preferred embodiment the plug 80 is a snap fit into the opening 22. In other embodiments it may merely be a friction fit in the opening 22 or it could be adhered in the opening 22.

In other embodiments (not shown) instead of using air pressure to move the piston 12, the piston 12 could be moved mechanically. This could be achieved by providing screw threads on the rod 30 and corresponding screw threads in the holes 72 and 74 so that when the rod is rotated the piston 12 is moved. Alternatively, the tube 20 could be dimensioned to extend all the way between the base of the drum and the lid of the drum and effectively perform the function of the rod and could also be screw threaded so that it engages screw threads in the opening 12 to enable mechanical movement of the piston 12.

The valves 16 and 26 could be provided in a single valve plate and arranged relatively close together to allow easy opening and closing of the valves by a single actuating handle or the like. The piston 12 could be made from metal or other rigid material which will not flex rather than plastics material and could have a flat base rather than an inclined base.

The dispenser may include more than one inner tube which can be each provided with a separate blade and arranged to extend through separate openings in the piston or a number of concentric tubes could be arranged to extend through a single opening in the piston and to be all cut by a common blade. Instead of providing a single blade more than one blade could also be incorporated.

We claim:

1. A dispenser for dispensing two components, said dispenser comprising a first container for containing one of the components and a second container for containing a second of the components, said first container having a first piston for movement int he first container for forcing the first component out of the first container, and said second container having a second piston for forcing the second component out of the second container, said dispenser further including a second piston moving means, including a cutting means fixed relative to the first piston for cutting said second container as the first piston is moved, for moving said second piston relative to said second container when said first piston is moved to thereby cause movement of the first piston and the second piston in a fixed manner relative to one another to dispense a predetermined amount of the first component and second component from the first and second containers respectively, and for providing that cutting of the second container by the cutting means enables movement of the first piston, the second piston moving means and the second piston relative to the first container and the second container, said second piston moving means comprising a blade extending across said second container and mounted above said second piston such that, upon movement of the first piston, the blade slices he second container and a portion of the blade abuts the second piston and pushes the second piston to cause the second piston to move with the first piston relative to the second container.

2. A dispenser for dispensing two components, said dispenser comprising an outer container for containing one of the components and an inner container for containing a second of the components, said outer container having a first piston.

3. The dispenser of claim 2 wherein said cutting means is fixed relative to the first piston and extends entirely across the inner container form one side of the inner container to the other side of the inner container, and wherein an intermediate portion of the cutting means abuts and pushes the second piston upon movement of the first piston.

4. A dispenser for dispensing two components, said dispenser comprising a first container for containing one of the components and a second container for containing a second of the components, said first container having a firs piston for movement int he first container for forcing the first component out of the first container, said second container having a second piston for forcing the second component out of the second container, a piston moving means, including a cutting means fixed relative to one of the pistons for cutting said second container as said one of the pistons is moved, for moving the other piston relative to one of said containers when said one of the pistons is moved to thereby case movement of the first piston and th second piston in a fixed manner relative to one another to dispense a predetermined amount of the first component and second component from the first and second containers respectively, and wherein cutting of the second container by the cutting means enables movement of the first piston, the piston moving means and the second piston relative to the first container and the second container, said dispenser further comprising a rod extending between a lid of one of the containers and abase of one of the containers for preventing the lid and the base form bowing during movement of the first and second pistons.

5. The dispenser of claim 4 wherein the cutting means extends entirely across the second container form one side of the second container to the other side of the second container.

* * * * *

UNITED STATES PATENT AND TRADEMARK OFFICE

CERTIFICATE OF CORRECTION

PATENT NO. : 5,181,629

DATED : January 26, 1993

INVENTOR(S) : Camm et al

It is certified that error appears in the above-identified patent and that said Letters Patent is hereby corrected as shown below:

Column 6, change claim 2, to read as follows:

2. A dispenser for dispensing two components, said dispenser comprising an outer container for containing one of the components and an inner container for containing a second of the components, said outer container having a first piston for movement in the outer container for forcing the first component out of the outer container, and said inner container having a second piston for forcing the second component out of the inner container, said dispenser further including a piston moving means including a cutting means fixed relative to one of the pistons for cutting said inner container as the said one of the pistons is moved and for moving the other piston relative to said inner container when said one of the pistons is moved to thereby cause movement of the first piston and the second piston in a fixed manner relative to one another to dispense a predetermined amount of the first component and second component from the outer and inner containers respectively, and for providing that cutting of the inner container by the cutting means enables movement of the first piston, the piston moving means and the second piston relative to the outer container and the inner container, said cutting means extending at least part of the way across said inner container and being mounted above said other piston such that, upon movement of said one of the pistons, the cutting means slices the inner container and a portion of the cutting means abuts the said other piston and pushes said other piston

UNITED STATES PATENT AND TRADEMARK OFFICE

CERTIFICATE OF CORRECTION

PATENT NO. : 5,181,629

DATED : January 26, 1993

INVENTOR(S) : Camm, et al

It is certified that error appears in the above-indentified patent and that said Letters Patent is hereby corrected as shown below:

to cause said other piston to move with said one of the pistons relative to the inner container.

Signed and Sealed this

Eighteenth Day of January, 1994

*Attest:*

Bruce Lehman

BRUCE LEHMAN

*Attesting Officer*

*Commissioner of Patents and Trademarks*